United States Patent [19]

Morgan et al.

[11] Patent Number: 4,632,076

[45] Date of Patent: Dec. 30, 1986

[54] METHOD OF MAKING A CONTROL DEVICE FOR DIESEL ENGINES

[75] Inventors: Richard L. Morgan, Utica; David A. Pickett, Monroe, both of Mich.

[73] Assignee: Allied Corporation, Morris Township, Morris County, N.J.

[21] Appl. No.: 570,149

[22] Filed: Jan. 12, 1984

Related U.S. Application Data

[62] Division of Ser. No. 398,006, Jul. 14, 1982, Pat. No. 4,442,804.

[51] Int. Cl.[4] ..... F02P 5/00; F02B 9/08

[52] U.S. Cl. ..... 123/145 A; 361/386

[58] Field of Search ..... 123/145 A, 179 B, 179 H; 361/386, 380, 392, 393, 381, 383

[56] References Cited

U.S. PATENT DOCUMENTS

| | | | |
|---|---|---|---|
| 4,060,847 | 11/1977 | Penrod | 361/386 |
| 4,096,546 | 6/1978 | Gabr | 361/386 |
| 4,177,499 | 12/1979 | Volkmann | 361/386 |
| 4,177,785 | 12/1979 | Sundeen | 123/145 A |
| 4,203,147 | 5/1980 | Gaber | 361/386 |
| 4,261,309 | 4/1981 | Biondi | 123/145 A |
| 4,296,454 | 10/1981 | Wong | 361/386 |
| 4,307,689 | 12/1981 | Raeske et al. | 123/145 A |
| 4,312,307 | 1/1982 | Cooper | 123/145 A |
| 4,330,812 | 5/1982 | Token | 361/386 |
| 4,470,002 | 9/1984 | Brown | 361/386 |

*Primary Examiner*—Raymond A. Nelli
*Attorney, Agent, or Firm*—Russel C. Wells

[57] ABSTRACT

The instant invention provides a simplified glow plug controller for energizing glow plugs to start a diesel engine, in a single, easy-to-mount enclosure including a first chamber and a second chamber, one chamber containing control circuitry and the second chamber containing a power relay.

6 Claims, 22 Drawing Figures

METHOD OF MAKING A CONTROL DEVICE FOR DIESEL ENGINES

This application is a division of application Ser. No. 398,006 filed July 14, 1982, now U.S. Pat. No. 4,442,804.

The instant application relates to a control circuit for an internal combustion engine, and in particular to a control circuit for controlling positive temperature coefficient (PTC) glow plugs for starting a diesel engine.

BACKGROUND OF THE INVENTION

As is well-known, diesel engines, being compression-ignition engines, need to compress a fuel-air mixture so that it reaches a temperature adequate to cause its ignition. During this compression, if not done rapidly, various leakages become more significant, and heat of compression is lost to the piston, cylinder walls and head of the engine, if these parts are not already adequately heated. Such problems arise upon starting a cold diesel engine. To compensate for the heat of compression that is lost under these conditions, glow plugs are provided to supply additional heat to the combustion chamber, to facilitate successful ignition of the fuel when it is sprayed by an injector into the heated air.

As will be apparent, some type of controller is necessary to turn glow plugs on and off at appropriate times, and under appropriate conditions, to give an operator an indication of when the engine may be easily started, and for insuring that the glow plugs become warm enough to facilitate starting, and not excessively warm, leading to premature failure or shortened lifetime.

There are two types of glow plugs in general use, the linear resistance type, and the positive temperature coefficient (PTC) type. The linear resistance type is unable to play any part in controlling its own temperature, although previously the same controllers have been used for both linear resistance and PTC type glow plugs. In the case of PTC type glow plugs, their resistance increases with temperature, limiting the current flow therethrough, and limiting the resultant temperature. Such a prior art controller is disclosed in U.S. Pat. No. 4,177,785, issued to Sundeen on Dec. 11, 1979. This patent also discloses the preferred glow plug temperatures, and the general structure and operation of a diesel engine as related to starting such an engine. As set forth therein, glow plugs may either be operated at their rated voltage, or may be operated above their rated voltage by cyclically completing and interrupting the glow plug heater element energizing circuit with a bimetallic element carefully matched to the thermal characteristics of the glow plugs. This arrangement requires a thermally operated circuit breaker that must be carefully designed so that it does not operate before the bimetallic element which cyclically energizes the glow plugs, imposing a design limitation which is difficult to meet over a large range of ambient temperatures, so that at one ambient temperature the circuit breaker may fail to operate in an appropriate time to protect the system from damage, while at another ambient temperature it may operate prematurely, removing power from the glow plugs before an adequate temperature has been reached.

Also, previous such control devices were either constructed as two separate assemblies, one assembly containing the control circuitry and a separate second assembly including a power relay, or had both the control circuitry and power relay in a common package, which did not isolate the control circuitry from heat generated by the coil and contacts of the power relay, so that, for instance, heating due to contact deterioration in the power relay, or resistive heating of its coil, would be detected as the equivalent to an increase in glow plug temperature, leading to a glow plug temperature below that considered to be sufficient for reliable starting. If placed in a common package, the entire package was discarded upon failure of any part of the device.

SUMMARY OF THE INVENTION

The instant invention provides a simplified glow plug controller for energizing glow plugs to start a diesel engine, in a single, easy-to-mount enclosure including a first chamber and a second chamber, one chamber containing control circuitry and the second chamber containing a power relay.

The control circuitry of the control device includes at least one temperature-actuated switch means and a second relay means, the temperature-actuated switch means being adapted to open at a predetermined time after the control circuitry is energized, a relay coil means of the second relay means being connected in a parallel arrangement with the temperature-actuated switch means, a relay contact means of the second relay means being electrically connected in series with the temperature-actuated switch means and with the power relay coil. The preferred control circuitry further includes, in an electrical series connection, second and third temperature-actuated switch means, the second switch means being an over-voltage switch, and the third switch means being a continuous conductor provided with switch means for providing a current path for energizing a lamp means and breaking the current path to de-energize the lamp at a predetermined time after the control circuitry is energized.

It is an advantage of the invention that either the power relay or the control circuitry may be conveniently easily replaced, either to provide for minor variations in the operation of the control circuitry, or in case of a failure occurring in the power relay or control circuitry.

It is a further object of the invention to produce a control device having a connector portion insert molded in an insulating block provided with apertures therein for severing the conductor assembly at a plurality of predetermined portions to form circuit elements, and providing a plurality of apertures therein for mounting series-connected bimetallic elements thereto, to provide a control device which is simple and convenient to make and assemble, and having a minimum number of separate pieces for enhanced reliability in use.

DETAILED DESCRIPTION OF THE INVENTION

Figure 1:
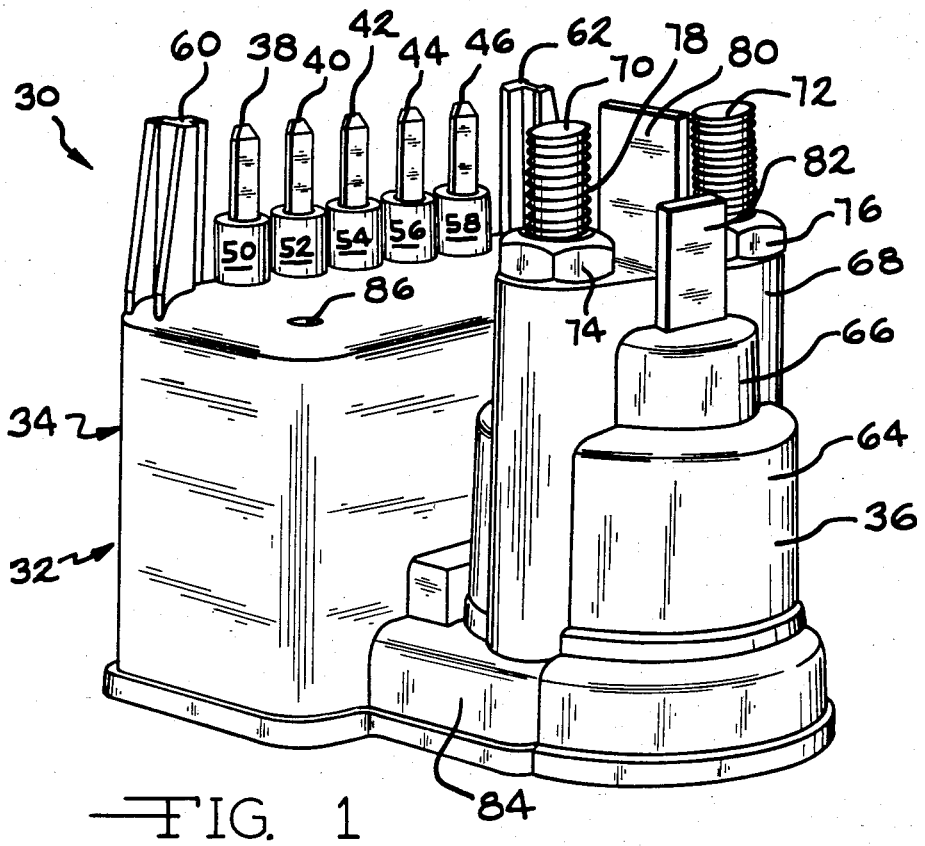
FIG. 1 is a perspective view of the exterior of the preferred embodiment of the invention.
Figure 2:
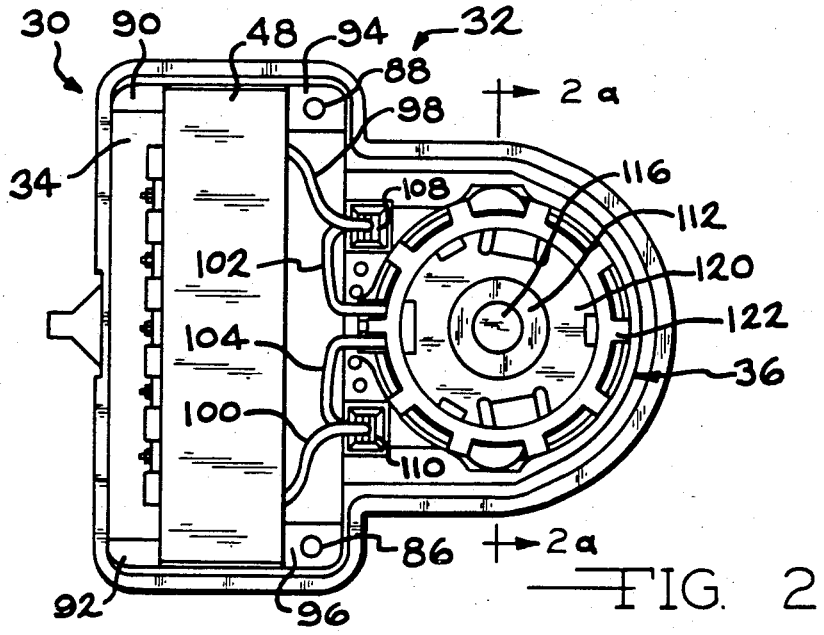
FIG. 2 is a bottom plan view of the preferred embodiment of the invention, shown with a bottom cover removed.

As shown in FIGS. 1 and 2, control device 30 includes a unitary housing member 32 defining a first chamber 34 for containing a control circuit assembly according to the invention, described in greater detail below, and a second chamber 36 for containing a first or power relay means. As best shown in FIG. 1, terminal members 38, 40, 42, 44 and 46 of a control circuit assembly 48 disposed in chamber 34 protrude through tower portions 50, 52, 54, 56 and 58. As will become apparent, for the embodiment shown in FIGS. 4–8, portions 50–58 are integral with member 32, and for the embodiment of FIGS. 10–15, they are integral with the control circuit. An appropriate sealing gasket member may be provided around terminal members 38–46. Projections 60 and 62 serve to guide a connector, not shown, into alignment with terminal members 38, 40, 42, 44 and 46. Second chamber 36 is defined by a cylindrical portion 64, for accommodating relay coil means, a second cylindrical portion 66 for accommodating a moving contact of the relay, and an elongated portion 68, to allow for the installation of fixed contacts, shown as integral with stud portions 70 and 72, protruding from chamber 36, and retained in place by nuts 74 and 76. Unitary housing member 32 also defines barrier portions 78, 80 and 82, for electrical separation between connections made to studs 70 and 72. Chambers 34 and 36 are joined by a connecting section 84, which may be of any convenient shape, for passage of conductors between first chamber 34 and second chamber 36, and for integrally mechanically connecting portions of unitary housing member 32. Control device 30 is mounted to a mounting surface by passing fastening means such as bolts through apertures 86 and 88. As shown most clearly in FIG. 2, spacer portions 90, 92, 94 and 96 position control circuit assembly 48 within chamber 34. Apertures 86 and 88 pass through spacer portions 94 and 96, respectively. Conductors 98 and 100 of control circuit assembly 98 are joined to leads 102 and 104 of relay coil 106, best shown in FIG. 2*a*, by fastening means 108 and 110.

Figure 2A:
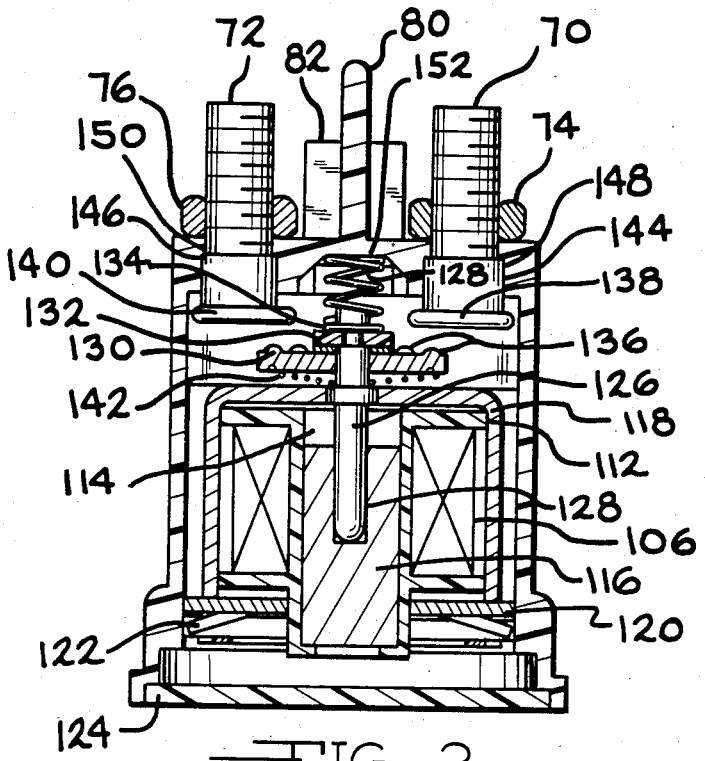
FIG. 2*a* is a sectional view taken along line 2*a*—2*a* in FIG. 2.

As can be seen in FIGS. 2 and 2*a*, relay coil 106 is wound on a coil form 112, which defines a central aperture 114 for guiding and retaining a ferrous moving element 116. Coil form 112 is itself retained within a ferrous cup-shaped member 118, and retained by a closure member 120. A toothed spring washer 122 retains this assembly within chamber 36. A cover plate 124 covers the open end of unitary housing member 32. As will be apparent, cover plate 124 may preferably be provided with gasket means for sealing, and may be removably fastened in place such as by self-tapping or self-drilling and tapping screws in several places about the periphery of plate 124.

As will be apparent, when relay coil 106 is energized, ferrous moving element 116 will attempt to center itself within coil 106, and will cause a pusher member 126, guided by an aperture 128 formed in moving element 116 to move against and resiliently compress helical spring 128. Pusher member 126 carries a movable contact member, retained to pusher member 126 by a washer 132 and a C-ring 134. Movable contact member 130 includes a plurality of contact protrusions 136.

As shown in FIG. 2*a*, stud portion 70 includes a fixed contact portion 138, and stud portion 72 includes a fixed contact portion 140. When movable contact member 130 is moved against the resistance of helical spring 128 so that contact protrusions 136 are in mechanical contact with contact portions 138 and 140, electrical connection will be established between stud portion 70 and 72. A spirally-wound spring 142 serves to rotationally advance movable contact member 130 with each actuation of relay coil 106, so that contact wear is distributed among contact protrusions 136. As shown, studs 70 and 72, with contact portions 138 and 140 are retained in stepped apertures 144 and 146, studs 70 and 72 being provided with shoulder portions 148, 150, respectively, for cooperating with stepped apertures 144, 146. As will be apparent, helical spring 128 bears against inside surface 152 of second chamber 36.

Figure 3:
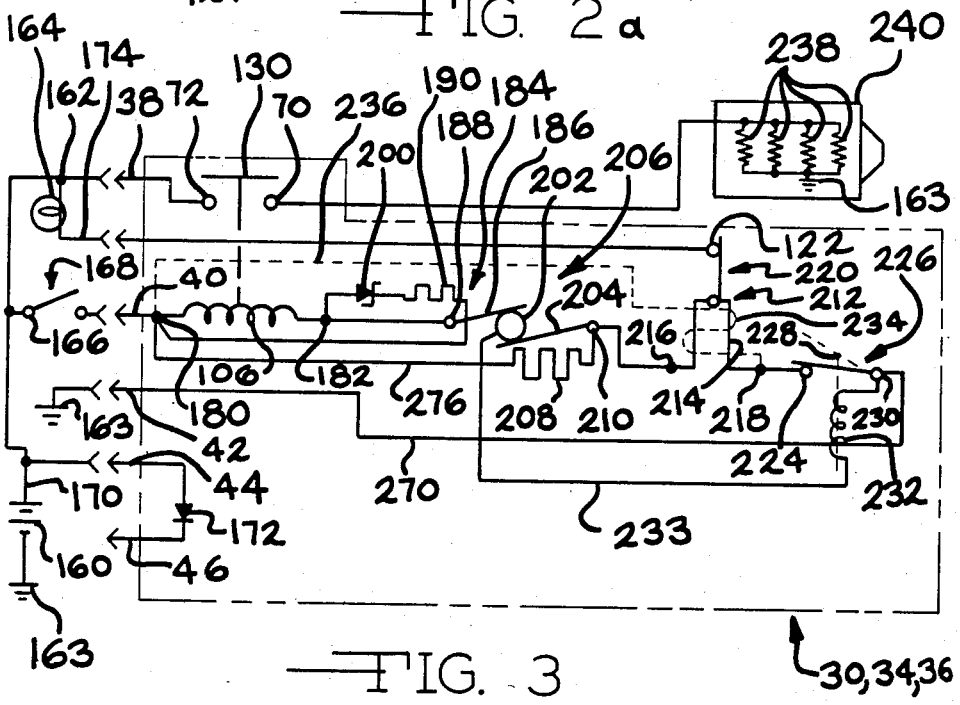
FIG. 3 is a circuit diagram of a first embodiment of the invention.

Referring now to FIG. 3, a circuit diagram of the preferred embodiment of the invention is shown. Where possible, reference numerals for the mechanical elements described above will be used. As shown, a source of electrical current illustrated as a battery 160 is connected between an electrical ground 163, the parallel combination of stud portion 72, a first terminal 162 of a lamp 164, a first terminal 166 of first switch means 168. First switch means 168 is preferably part of a conventional ignition switch, which is closed during an attempt to start a vehicle engine. As illustrated, first switch means 168 is connected between the positive terminal 170 of battery 160 and a terminal member identified with the reference numeral 40. Positive terminal 170 is further connected to a terminal identified with reference numeral 44. A diode 172 may be connected between terminal members 44 and 46, if desired, such as for use in a conventional alternator warning light circuit, not shown, which is not part of the invention. This mounting of diode 172 merely makes use of otherwise unused terminals in the illustrated embodiment of the invention. Lamp 164 has a second terminal 174 connected to a terminal member identified with reference numeral 38.

First relay coil means 106 has a first terminal connected to a junction 180, directly electrically connected to terminal member 40, and a second terminal directly connected to junction 182. A second temperature-actuated switch means 184 includes a bimetallic movable element 186, which has a first terminal 188 directly electrically connected to junction 182, and an associated heater 190 having a first terminal connected to junction 180, and a second terminal connected to junction 182. In the preferred embodiment of the invention illustrated, second temperature-actuated switch means 184 operates as an overvoltage safety switch, and thus may include a zener diode 200 having an anode connected to junction 182 and a cathode connected to associated heater 190. The use of a zener diode 200 insures that current will not start to flow through heater 190 until a predetermined voltage is reached. However, it is believed to be preferable to design heater 190 so that it will not supply sufficient heat to element 186 to cause switch 184 to open until a predetermined voltage is applied. Movable element 186 cooperates with a fixed contact 202, as does a second bimetallic movable element 204 of third temperature-actuated switch means 206, provided with an associated heater 208. Associated heater 208 has a first terminal connected to junction 180 and a second terminal connected to first terminal 210 of second bimetallic movable element 204. Third temperature-actuated switch means 206 is used as a timer to de-energize the glow plugs following either a successful start or failure to start.

In order to give the operator an indication that the glow plugs have reached an adequate temperature, a fourth temperature-actuated switch means 212 is provided. Switch means 212 is shown schematically as composed of a continuous conductor 214 having a first terminal 216 connected to terminal 210, and a second terminal 218. Conductor 214 is a bimetallic element, preferably in a U-shaped configuration, having switch means 220 cooperating with a fixed contact 222 intermediate first terminal 216 and 218.

Terminal 218 is electrically connected to a fixed contact 224 of relay means 226. Relay means 226 is, in the preferred embodiment of the invention, used as a lockout and reset relay which has a movable element 228 cooperating with fixed contact 224, and a terminal 230, electrically connected to terminal member 42 and ground 163. Relay means 226 includes coil means 232, having a first end connected to terminal 230 and a second end connected to fixed contact 202, electrically interposed between elements 186 and 204.

Fourth temperature-actuated switch means 212 is shown as having an auxiliary heater means 234 connected between second terminal 218 and junction 180. Heater 234, and the conductor 236 which joins it to junction 180, are shown in broken line, since such an auxiliary heater is not necessary in the preferred embodiment of the invention, conductor 214 being chosen to provide appropriate self-heating to open switch means 212 at a predetermined time following application of power. However, it is believed that auxiliary heater 234 may be incorporated to adapt the control device according to the invention for different size engines, which may require a different time to pre-heat, without varying the dimensions of continuous conductor 214.

Upon closing first switch means 168, current flows from positive terminal 170 of battery 160, through relay coil 106, second temperature-actuated switch means 184, third temperature-actuated switch means 206, and movable element 228 of relay means 226 to terminal member 42 and ground 163. Current may also flow through auxiliary heater 234, if provided, and through heater 190 of second temperature-actuated switch means 184, depending on the applied voltage and the parameters of zener diode 200, if it is provided. Current will not flow through coil means 232 at this time, since the potential existing at fixed contact 202 is essentially ground potential, and coil means 232 has a substantially higher impedance than the path through movable element 204, continuous conductor 214 and movable element 228.

At an interval of approximately 8.5 seconds after first switch means 168 is initially closed, induced heating in continuous conductor 214 will cause it to deflect, opening switch means 220, and removing a path to ground from second terminal 174 of lamp 164, extinguishing lamp 164 and signaling an operator that the engine can be started.

When switch means 168 was initially closed, therefore, relay coil 106 is energized, and movable contact member 130 interconnects stud portions 70 and 72, applying current from battery 160 to glow plugs 238, connected in parallel arrangement and to ground 163 of engine 240.

At an interval of approximately 60 seconds after first switch means 168 is initially closed, associated heater 208 of third temperature-actuated switch means 206 will have provided sufficient heat to cause second bimetallic movable element 204 to break contact with fixed contact 202. Upon this occurrence, the voltage appearing at fixed contact 202 will change from substantially ground voltage to the voltage provided by battery 160. This will result in current flow through coil means 232, causing relay means 226 to open as movable element 228 separates from fixed contact 224. This also de-energizes relay coil 106, in turn de-energizing glow plugs 238. Subsequent to this event, associated heater 208 cools, due to its loss of a ground path through conductor 214 and relay means 226. However, relay means 226 will remain in an open condition, maintaining the glow plugs in a de-energized state. However, should the operator choose to open first switch means 168 momentarily, and then close it again, relay means 226 would resume its normallyclosed position, allowing glow plugs 238 to be energized for an additional period of time. Also, as will be described more fully below in connection with FIGS. 22–27, a slight modification of the invention will allow movable contact member 130 to be forced to a closed position between stud portions 70 and 72 whenever the engine 240 is being cranked.

Figure 6:
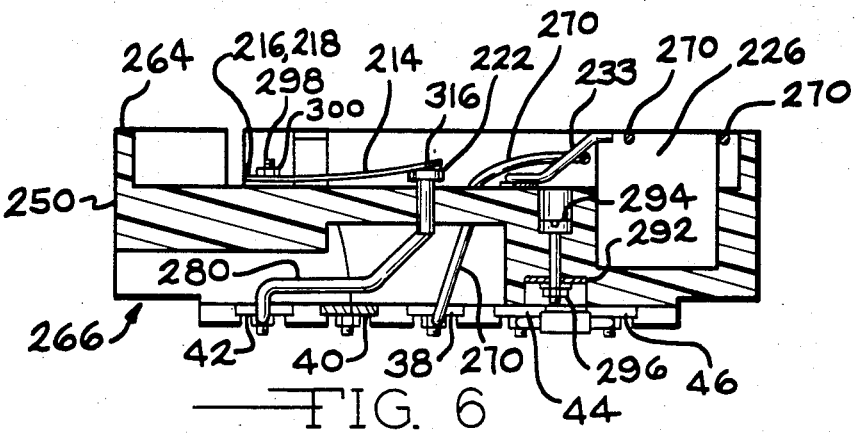
FIG. 6 is a sectional view taken along line 6—6 in FIG. 4.
Figure 7:
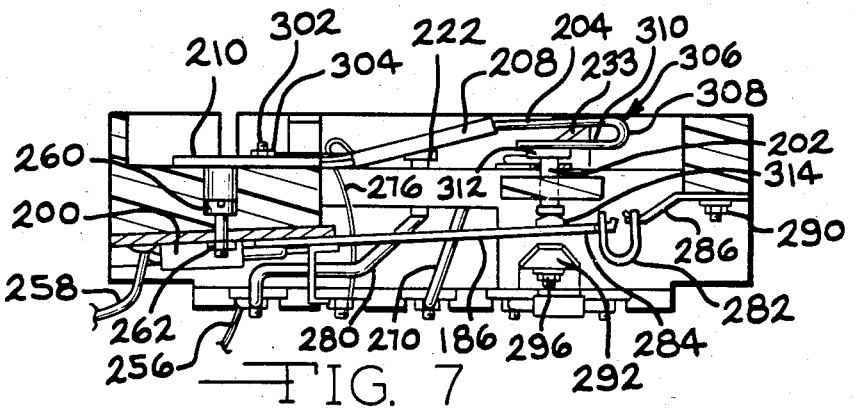
FIG. 7 is a sectional view taken along line 7—7 in FIG. 5.
Figure 8:
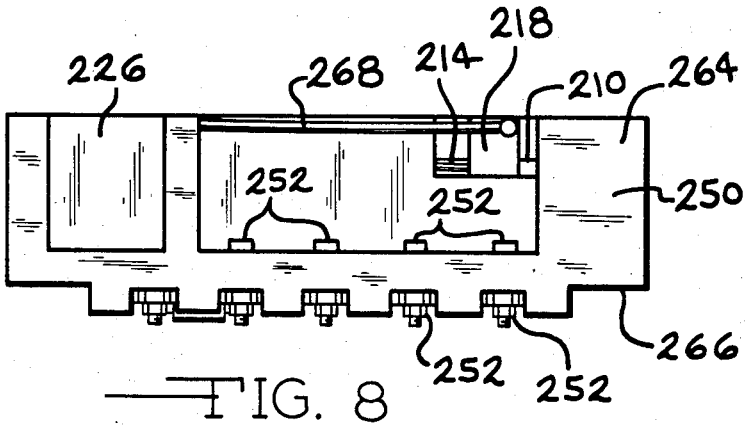
FIG. 8 is a front elevational view of the first embodiment of the invention.

FIGS. 4–8 are views of a first physical embodiment of the invention. For clarity, identical numbers will be used for physical embodiments of items shown on the schematic of FIG. 3 wherever possible. As shown in FIG. 6, terminal members 38, 40, 42, 44 and 46 are affixed to a mounting block 250 by fastening means shown as screws 252 and nuts 254.

When voltage is applied to terminal member 40, current flows through relay coil 106 through conductor 256 and returns to junction 182 through conductor 258.

As shown, junction 182 is formed on first terminal 188 by soldering conductor 258 and the anode lead of zener diode 200 thereto. First terminal 188 is fastened to mounting block 250 by screws 260 and nuts 262. From junction 182, current flows through bimetallic movable element 186 to fixed contact 202 which extends between first side 264 and second side 266 of mounting block 250. From fixed contact 202, current then flows primarily through second bimetallic movable element 204, to first terminal 210. First terminal 210 is directly connected to first terminal 216 of continuous conductor 214, shown formed in a U-shape, and from second terminal 218 of conductor 214 through conductor 268 to terminal 224 of relay 226. Relay 226 is a conventional miniature double pole-double throw relay, mounted inverted from its usual application, where it is mounted to a printed circuit board. From terminal 230, current then flows through conductor to terminal member 42. Heater 190 has a first terminal connected to junction 180 by soldering a lead tab of heater 190 to terminal member 40 at joint 272, and a second terminal connected to the cathode of diode 200 by soldering at joint 274. Heater 208 has a first terminal connected to junction 180 by conductor 276, fastened to terminal member 40 at nut 254, and a second terminal connected to terminal 210 by soldering at junction 278.

A fixed contact 222 is disposed adjacent the bight of U-shaped continuous conductor 214, and connected to terminal member 38 by a conductor 280. To insure rapid and positive switch action of second bimetallic movable element 204, an overcenter spring means shown as a U or Omega-shaped spring has a first end connected to the free end 284 of element 204, and a second end connected to a bracket 286 affixed to mounting block 250 by screw 288 and nut 290. Spring 282 operates to keep member 204 in one of two positions, in a bistable manner. To prevent element 196 from reaching a stable position distal from contact 202, a stop member 292 affixed to block 250 by screw 294 and nut 296 is provided, so that element 186 cannot assume a stable position distal to fixed contact 202.

Figure 4:
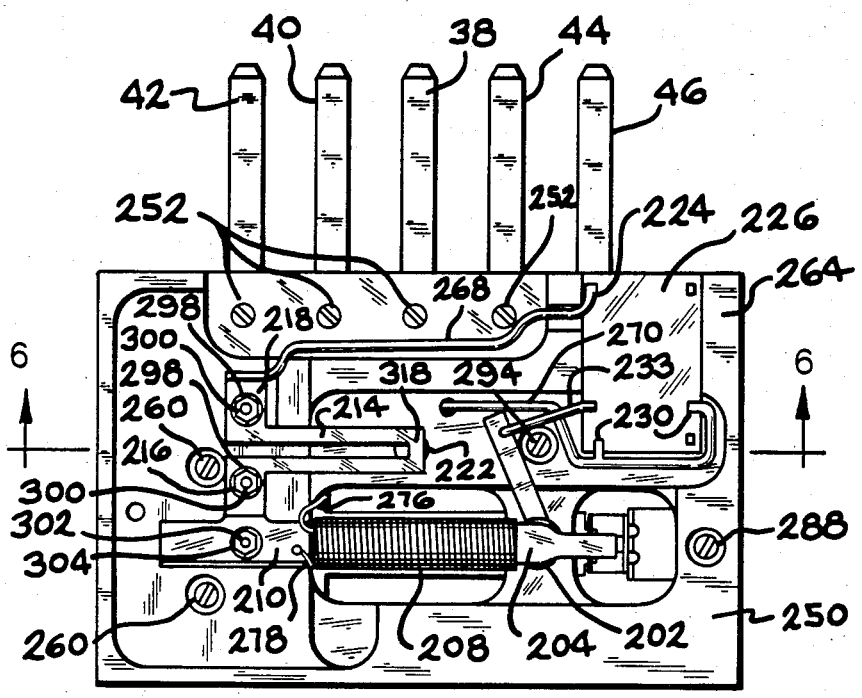
FIG. 4 is a top plan view of a control circuit assembly according to the first embodiment of the invention.
Figure 5:
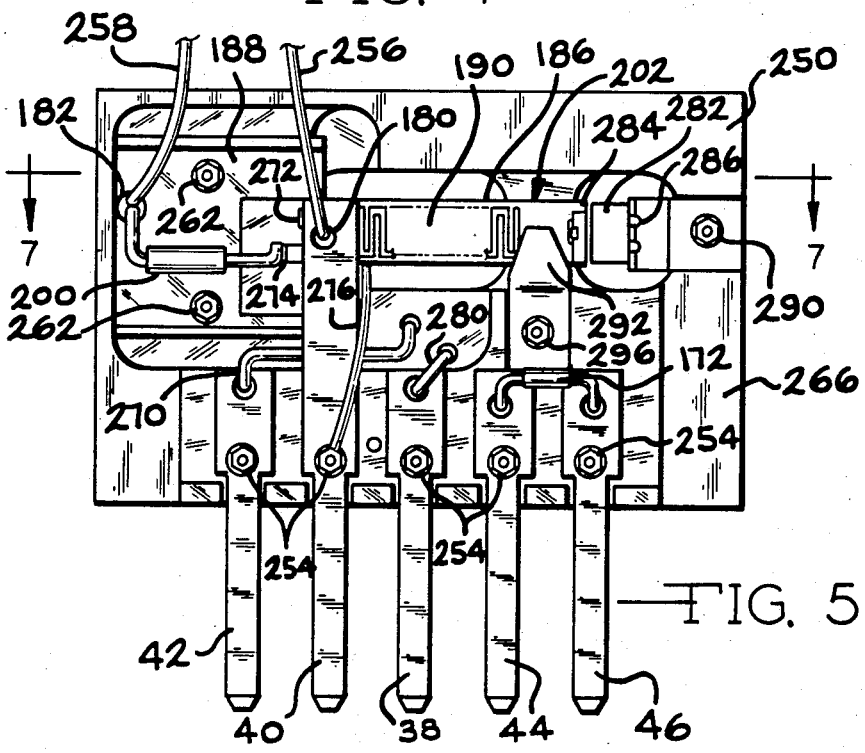
FIG. 5 is a bottom perspective view of a control circuit assembly according to the first embodiment of the invention.
Figure 10:
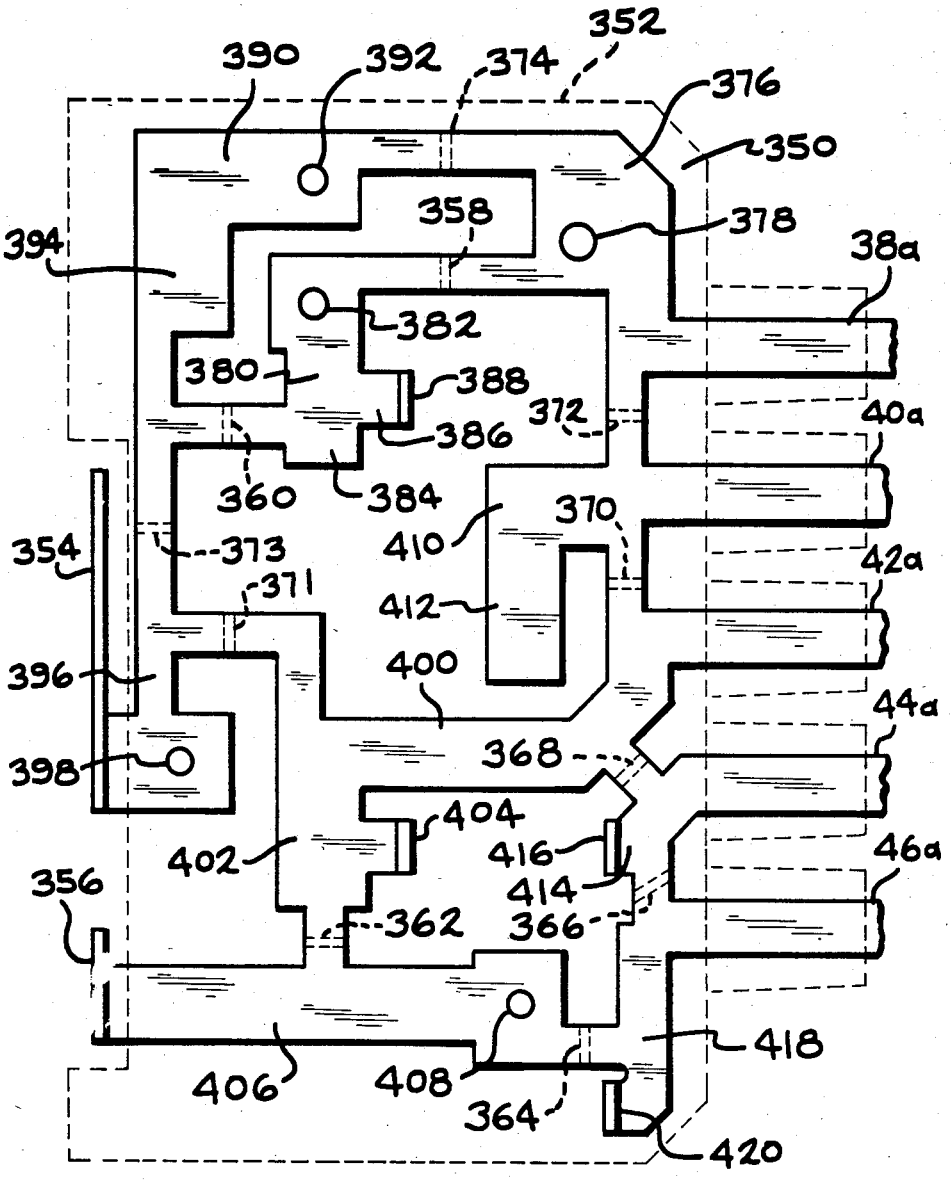
FIG. 10 is a top plan view showing the conductor assembly used in the second embodiment of the invention as shown in FIG. 10–15.

As can be seen in FIGS. 4 and 6, terminal portions 216 and 218 of continuous conductor 214 are each retained by screws 298 and nuts 300. First terminal 210 is also attached to block 250 by a screw 302 and a nut 304. As can be seen most clearly in FIG. 7, second bimetallic movable element is provided with a U-shaped tip portion 306 defining a bight portion 308 and a leg portion 310. A contact member 312 is attached to leg 310 adjacent fixed contact 202, such as by welding or brazing. As also shown in FIG. 10, a contact member 314 is provided on member 186 adjacent fixed contact 202. Also, a contact member 316 may beneficially be provided at bight portion 318 of continuous conductor 214, such as by welding it to conductor 214.

Referring now to FIGS. 9 through 16, there is shown the preferred embodiment of the invention, differing from that shown in FIGS. 3–8 in that components have been rearranged for greater ease in manufacturing, the mounting block is molded around an interlinking conductive pattern member, and relay means 226 has been replaced by a relay using discrete components. The circuit diagram differs from that shown in FIG. 3 in that the arrangement of various parts of the invention differs in order of appearance, and single fixed contact 202 has necessarily been eliminated. Wherever possible, identical numbers will be used for clarity, suffixed with the letter "a". The function of the circuit remains the same as described above.

Figure 9:
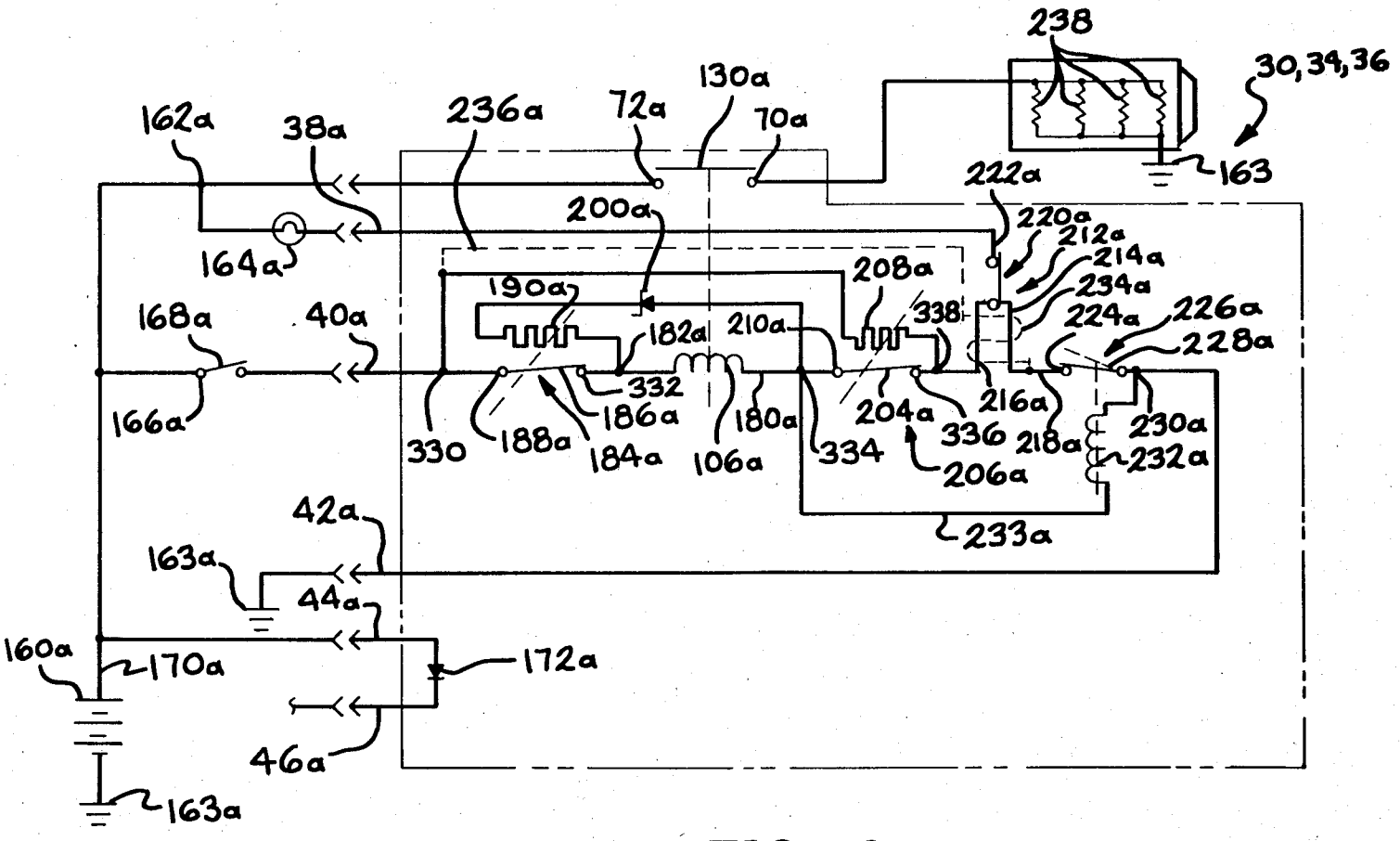
FIG. 9 is a circuit diagram of the preferred embodiment of the invention.

As can be seen in FIG. 9, a junction 330, rather than junction 180, is directly connected to a terminal member identified as **40*a*. A first terminal 188*a* of a second temperature actuated switch means 184*a* is connected to junction 330, and fixed contact 332 of switch means 184 is connected to a junction 182*a*. Relay coil 106*a* has a first end connected to junction 182*a*, and a second end connected to junction 180*a*, which is in turn connected to junction 334. Associated heater 190*a* and its optional series zener diode 200*a* are connected between junction 182*a* and junction 334. Third temperature-actuated switch means 206*a* has a first terminal 210*a* connected to junction 334, and a fixed contact 336 connected to a junction 338. Associated heater 208*a* is connected between junction 338 and junction 330**.

A fourth temperature-actuated switch means **212*a* has a first terminal 216*a* connected to junction 338, and a second terminal 218*a*. Terminal 218*a* is connected to fixed contact 224*a* of normally-closed relay means 226*a*, and coil means 232*a* of relay means 226*a* is connected between terminal 230*a* and junction 334. Terminal 230*a* is connected to terminal member 42*a* and ground 163*a*. As illustrated, a conductor 236*a* joins junction 330 and auxiliary heater 234*a***, if such a heater is desired.

When first switch **168*a* is closed, current flows through second switch 184*a*, relay coil 106*a*, switch 206*a*, continuous conductor 214*a* and movable element 228*a* of relay means 226*a* to ground 163*a*, energizing relay coil 106*a*, and causing movable contact member 130 to electrically interconnect stud portions 70 and 72, to energize glow plugs 238. After a first predetermined time, current through continuous conductor 214*a* or auxiliary heater 234*a*, or both of them, cause switch means 220*a* to open, extinguishing lamp 164*a*, to notify an operator that engine 240 is ready to be started. At a second predetermined time, switch 206*a*, heated by associated heater 208*a*, opens, deenergizing relay coil 106*a* and glow plugs 238. At this time, junction 334, which had been substantially at the potential of ground 163*a*, assumes substantially the potential of positive terminal 170*a* of battery 160*a*, causing current to flow through a conductor 233*a* attached to junction 334, and through coil means 232*a* of relay means 226*a*, and then to ground 163*a* through terminal member 42*a*. This causes movable element 228*a* to open the circuit through relay means 226*a*. maintaining relay coil 106*a*** in de-energized condition.

If switch **168*a* is momentarily opened, associated heater 208*a* will be de-energized, allowing movable element 204*a* to close switch means 206, and the removal of power by this action will allow relay means 226*a* to assume its normally-closed position, again energizing relay coil 106*a* and glow plugs 238**.

Referring now to FIG. 10, there is shown a conductor assembly 350, illustrated within an outline drawing of mounting block 352. As can be seen, conductor assembly 350 is an integral assembly which is later severed at selected locations to form an appropriate conductor pattern for a control device according to the invention. As illustrated, conductor assembly 350 includes terminal members **38*a*, 40*a*, 42*a*, 44*a* and 46*a*, and has output tabs 354 and 356, for connection of conductors leading to relay coil 106*a*. As will be apparent, conductor assembly 50 is stamped from an appropriate material, molded within mounting block 352, and subsequently severed at severance areas 358, 360, 362, 364**, 366, 368, 370, 372 and 374. As will be apparent, these severance areas are removed by punching through aligned apertures in mounting block 352, after it is molded around conductor assembly 350. After removing of severance areas 358, 360, 362, 364, 366, 368, 370, 372 and 374, conductor assembly 350 defines a plurality of circuit elements including first area 376 integral with terminal member 38*a* and having a circular aperture 378 therethrough, for subsequent installation of a fixed contact such as contact 222*a* of fourth temperature-actuated switch means 212*a* and defined between severance areas 358, 372 and 374. A second area 380 includes a circular aperture 382, for subsequent connection of second terminal 218*a* of switch means 212*a*, and a portion 384 for subsequent use as part of either fixed contact 224 or terminal 230 of relay means 226 and is defined between severance areas 358 and 360. A second portion 386 of area 380 includes a tab 388, bent at right angles to the plane of conductor assembly 350, for subsequent use in establishing connection to one of the two leads or terminals of associated heater 208*a*. A third area 390 defined between severance areas 360, 373 and 374, includes a circular aperture 392, for use in establishing connection to terminal 218*a* of continuous conductor 214*a*, and a portion 394 for subsequent attachment of fixed contact 336 of third temperature-actuated switch means 206*a*. A fourth area 396 defined by severance areas 371 and 373 includes a circular aperture 398, for use in mounting first terminal 210 of switch means 206, and also includes output tab 354, bent perpendicular to the plane of conductor assembly 350. A fifth area 400 integral with terminal member 42*a* and defined by severance areas 362, 368, 370 and 371 includes a portion 402, for subsequent connection of one of the contacts or terminals, either 224*a* or 230*a* of relay means 226*a*, and a tab portion 404, bent perpendicular to the plane of conductor assembly 350, for connection of the lead of coil means 232*a* connected to terminal 230*a*. A fifth area 406 defined by severance areas 362 and 364 includes a circular aperture 408 for mounting first terminal 188*a* of second switch means 184, and further includes output tab 356, bent at right angles to the plane of mounting block 352. A sixth area 420 integral with terminal member 40*a* and defined by severance areas 370 and 372 includes a portion 412 for use in mounting fixed contact 332 of switch means 184*a*. A seventh area 414 integral with terminal member 44*a* and further defined by severance areas 366 and 368 includes a tab member 416, bent at right angles to the plane of mounting block 352, for connection of one terminal of diode 172*a*. An eighth area 418 integral with terminal member 46*a* and defined by severance areas 368 and 364 includes a tab 420, bent at right angles to the plane of mounting block 352, for connection of the other end of diode 172*a*. Diode 202*a*, if provided, may be attached such as by welding or soldering to a convenient portion of area 396 and to a connection tab portion, not shown, of laminated associated heater 190*a*.

As will be apparent, devices connected to apertures such as 378, 382, 392, 398 and 408 are preferably attached by riveting, and devices attached to other areas are preferably attached by welding, through apertures in mounting block 350 described in detail below. Wire wound associated heater 208*a* is connected between tab 388 and area 410, such as by welding to area 410. The leads of coil means 232*a* of relay means 226*a* are respectively attached to tab 404, and either to output tab 354 or to area 396, such as by welding in any suitable location, connection to a rivet or the like passing through aperture 398, or to the end of second bimetallic movable element 204*a* attached adjacent aperture 398.

Figure 11:
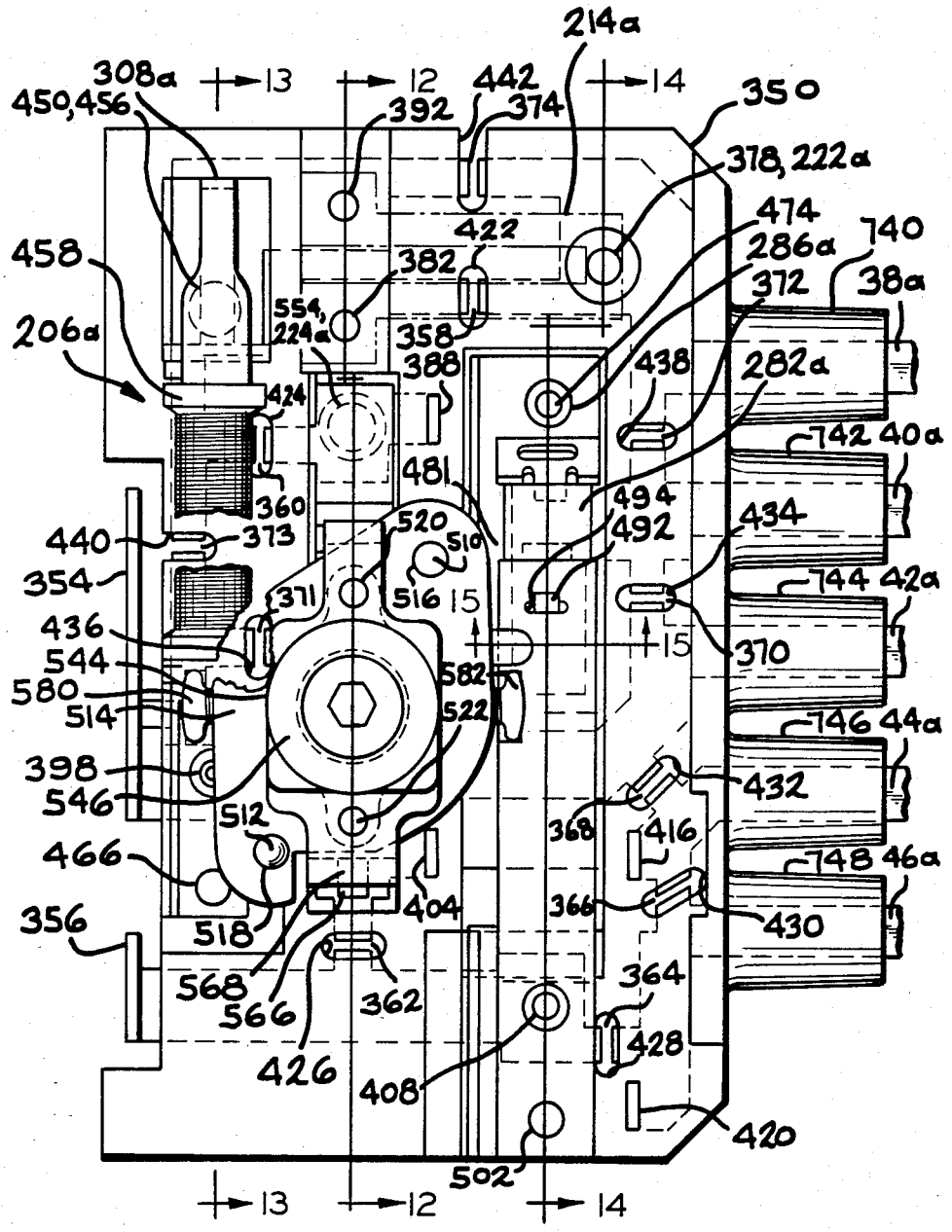
FIG. 11 is a top plan view of a control circuit assembly according to the preferred embodiment of the invention.

Turning now to FIG. 11, there is shown a top plan view of the preferred embodiment of the invention.

As will become apparent, certain components, illustrated in FIGS. 4 through 8, are omitted from the view of FIG. 11 for clarity. As shown in FIG. 11, access to conductor assembly 350 after it is molded into mounting block 352 for removing severance areas 358, 360, 362, 364, 366, 368, 370, 371, 372, 373 and 374 is provided by respective apertures 422, 424, 426, 428, 430, 432, 434, 436, 438, 440 and 442 formed in mounting block 352.

Figure 13:
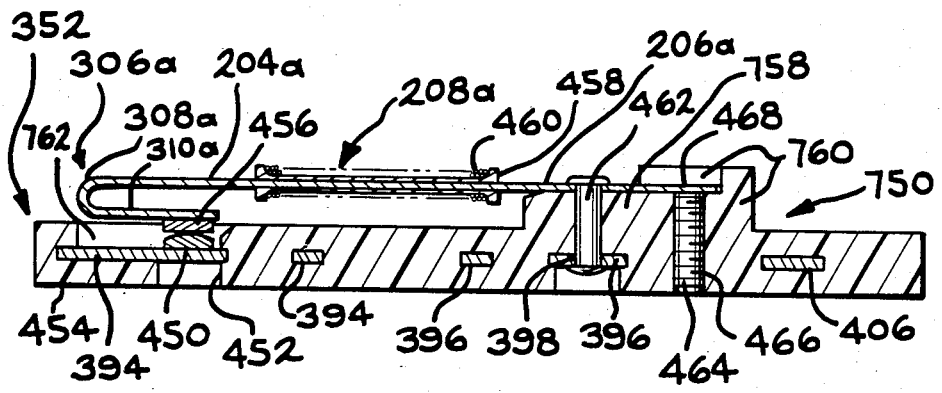
FIG. 13 is a sectional view taken along line 13—13 in FIG. 11.

As shown in FIGS. 11 and 13, third temperature-actuated switch means 206*a* includes a fixed contact 450 welded to portion 394, and aperture 452 being provided in surface 454 of mounting block 352 for this purpose. A movable contact 456 is shown affixed to leg portion 310, preferably by welding. Associated heater 208*a* is shown as having a wire-wound associated heater 208*a*, including a split bobbin member 458 which is wrapped around element 204*a*, and a resistance wire winding 460. The ends of winding 460 are connected as described in conjunction with the description of FIG. 10 above. Resistance wire winding 460 is omitted from the illustration of FIG. 11 for clarity. Second bimetallic movable element 204*a* is mounted in a cantilever fashion and pivoted about fastening means shown as rivet 462, passing through aperture 398 in fourth area 396, and adjusted by means of a set screw or the like 464 threaded into aperture 466 in surface 454 and adjustably bearing against end 468 of member 204*a*. By adjusting set screw 464, the contact pressure between contacts 450 and 456 may be adjusted, thus adjusting the quantity of heat required to be supplied to member 204*a* to cause it to flex sufficiently to separate contacts 450 and 456.

Figure 14:
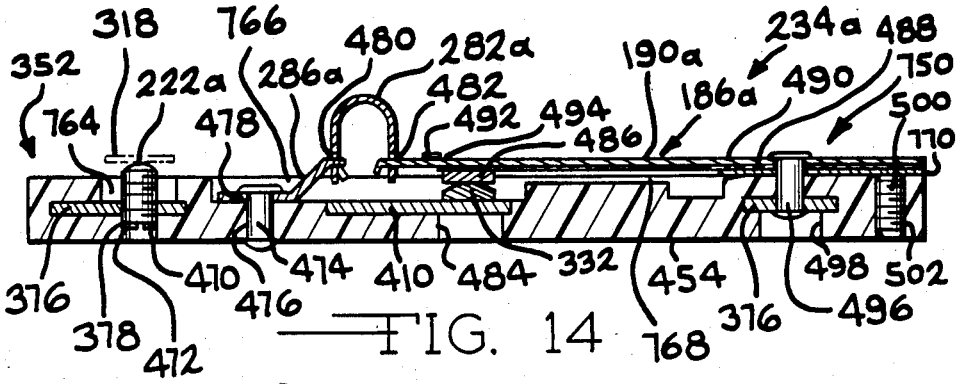
FIG. 14 is a sectional view taken along line 14—14 in FIG. 11.
Figure 15:
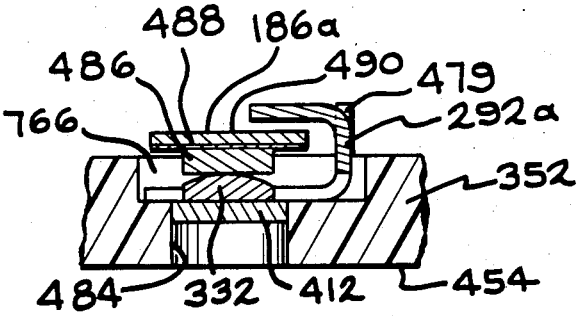
FIG. 15 is a sectional view taken along line 15—15 in FIG. 11.

As shown in FIGS. 11 and 14, fixed contact 222 is provided by a set screw 470 threadably engaging aperture 378 in conductor assembly 350 and aperture 472 provided for this purpose in surface 454. Bracket 286*a* is shown as fastened to mounting block 352 by fastening means shown as a rivet 474 passing through an aperture 476 in surface 454 of mounting block 352, and an aperture 478 in bracket 286*a*. As best shown in FIGS. 11 and 15, bracket 286*a* includes a side arm portion 479 and stop member 292*a*. Omega-shaped spring 282*a* is mounted in a tongue-and-slot fashion at end 480 of bracket 286*a* and at end 482 of element 186*a*. Fixed contact 332 is welded to fixed area 410 through an aperture 484 provided in surface 454 for this purpose. Movable contact 486 is affixed to a contact carrier member 488, which may be attached to bimetallic member 490 in any convenient fashion, such as by a tab 492 protruding through a slot 494 in member 490. A fastening means shown as a rivet 496 inserted through an aperture 498 provided in surface 454 retains bimetallic element 490, contact carrier member 488 and a stiffener member to mounting block 352, and electrically connects these elements to first area 376 of conductor assembly 350. A set screw 500 threadably engaging an aperture formed in surface 454 bears against stiffener member 496, which in turn bears against contact carrier member 488 and bimetallic element 490, to adjust the pressure between contacts 486 and 332, to control the quantity of heat that must be provided by laminated auxiliary heater 234*a* to separate these contacts.

Figure 12:
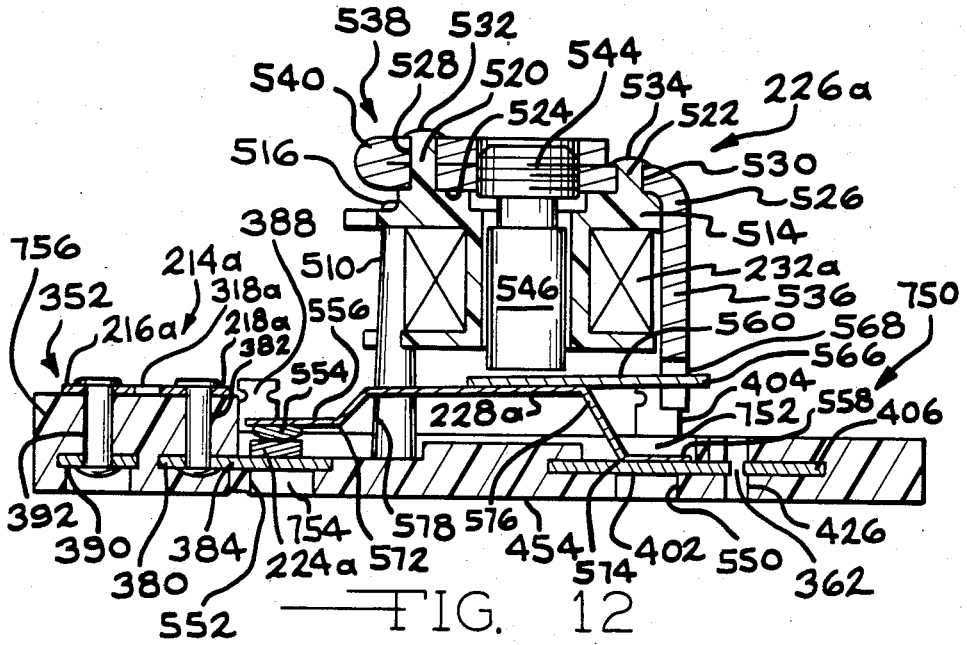
FIG. 12 is a sectional view taken along line 12—12 in FIG. 11.

Referring now to FIGS. 11 and 12, the preferred structure of relay means 226*a* is illustrated. As shown, posts 510 and 512, integral with and projecting perpendicular to mounting block 352, support a bobbin member 514, on which a winding constituting coil means 232*a* is placed. Bobbin member 514 is retained to posts 510, 512, by hot-forming their free ends to form retaining portions 516, 518 respectively. Bobbin member 514 contains projections 520, 522 from surface 524 of bobbin member 514, extending perpendicular to the plane of mounting block 352 and surface 524, for holding a bracket member 526 adjacent bobbin member 514. As will become apparent, bracket member 526 forms part of a magnetic path for coil means 232*a*. Bracket member 526 defines apertures 528, 530, for cooperating with projections 520, 522. Bracket member 526 is retained to bobbin member 514 by hot-forming the free ends of projections 520, 522 to form retaining portions 532, 534. As shown, bracket member 526 is an L-shaped bracket, having a first portion 536 disposed perpendicular to the mounting block 352 and a second portion 538 disposed parallel to mounting block 352. Second portion 538 contains a folded-back end section 540, effectively making second portion 538 twice the thickness of first portion 536. Portion 538 contains a threaded aperture, cooperating with threads 544 of core member 546, to adjustably retain core member 546. A first end of movable element 228*a* is fastened to portion 402 such as by welding, utilizing aperture 550 formed in surface 454 for this purpose. A fixed contact 224*a*, is fastened to portion 384 of conductor assembly 350, such as by welding, utilizing an aperture 552 formed in surface 454 for this purpose. Member 228*a* is provided with a movable contact 554, fastened at a first end thereof adjacent fixed contact 224*a*. Intermediate first end 556 and second end 558, fastened to portion 402, a flux path member 560 is affixed to member 228*a* in any convenient manner, preferably by welding thereto. Flux path member 560 has a first end fastened to member 226*a* and a second end including a tab portion 566 which engages a slot 568 formed in free end 570 of first portion 536 of bracket member 526. Member 228*a* is bent in a first direction at areas 572 and 574, and in second direction at areas 576, 578 intermediate areas 572 and 574, to position flux path member adjacent core member 546, and mounted so that its natural resilience maintains contacts 554 and 224*a* in electrical contact. As will be apparent, when coil means 232 is energized, flux path member 560 will be attracted to core member 546, with member 226*a* pivoting about its point of attachment to area 402, and tab portion 566 of flux path member 560 rotating within the confines of slot 568. Tab portion 566 may be provided with an enlarged end portion, not shown, to hold tab portion 566 in slot 568 during welding of end 558.

Figure 16:
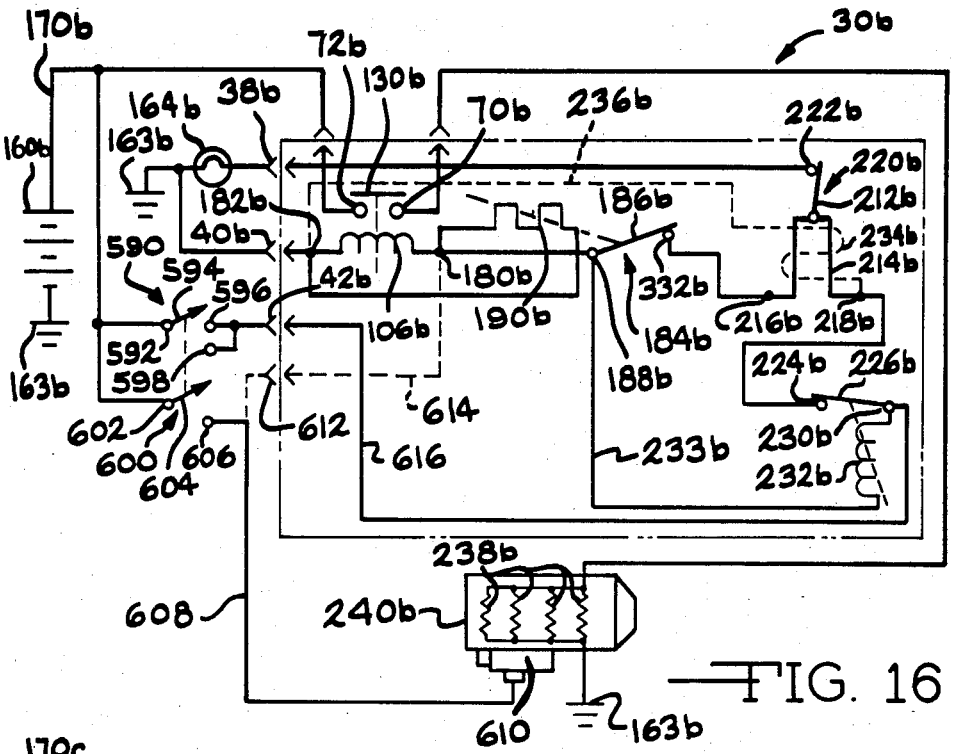
FIG. 16 is a first alternate circuit diagram for a control circuit according to the invention.

Turning now to FIG. 16, there is shown an alternate embodiment of the invention, utilizing only one temperature-actuated switch means. As will become apparent from the description which follows, either one of switch means 184 or 206 may be eliminated, such as by replacing it with a simple bridging member in mounting block 352, bridging appropriate areas of conductor assembly 350, in a manner which will be obvious from inspection of FIGS. 10–15. FIGS. 16–21 illustrate various embodiments of the invention, utilizing either one or two temperature-actuated switch means, and including means for forcing the energization of glow plugs whenever the engine is being cranked, so that an operator may attempt to start the engine whether or not it is ready or able to be started.

Referring now to FIG. 16, it may be seen that components having similarities to that shown in earlier figures are identified with the same reference numerals, together with the suffix "b". As shown in FIG. 16, the polarity applied to the embodiment illustrated is reversed from that of the embodiment shown in FIG. 9, so that a positive voltage used for cranking an engine 240*b* may also be used to force the energization of glow plugs 238*b*. Thus, terminal member 40*b* is connected to ground 163*b*, and terminal member 42*b* is connected to positive terminal 170*b* of battery 160*b* through a switch means 590, switch means 590 having a first terminal 592 connected to positive terminal 170*b*, a movable element 594, and fixed contacts 596 and 598 connected to terminal member 42*b*. Switch means 590 is shown as interlinked with switch means 600, which includes a first terminal 602 connected to positive terminal 170*b*, a movable element 604 and a fixed contact 606, connected through a conductor 608 to a cranking means 610 of engine 240*b*. Fixed contact 606 is also connected to a terminal member 612 of control device 30*b*, and terminal member 612 is connected to a conductor 614, shown in dashed lines, connected to junction 180*b*. As will be apparent, conductor 614 is optional, for use if it is desired to use means for forcing energization of glow plugs 238*b* during cranking of engine 240*b*.

When switch means 590 is actuated to bring movable element 594 in contact with fixed contact 596, current will flow through conductor 616, to terminal 230*b* of relay means 226*b*, through relay means 226*b* to contact 224*b* from terminal 218*b* to terminal 216*b* through continuous conductor 214*b*, fixed contact 332*b* of switch means 184*b*, through movable element 186, to junction 180*b*, and through relay coil 106*b*, to junction 182*b*, terminal member 40*b* and ground 163*b*. If an optional heater means 234*b* is provided, current will also flow from terminal 218*b* through optional heater means 234*b*, through conductor 236*b* to junction 182*b*, and to ground 163*b*. Current will also flow through associated heater 190*b*, from junction 180*b*, which at this time is substantially at the potential of positive terminal 170*b* of battery 160*b*, to junction 182*b*, which is substantially at the potential of ground 163*b*. At a first predetermined time, switch means 220*b* will open, extinguishing lamp 164*b*. At a second predetermined time, switch means 184*b* will open, de-energizing glow plugs 238*b*. At this time, relay means 226*b* is opened, since terminal 188*b*, which was maintained at a high potential, is now at a potential substantially that of ground 163*b*. If switch means 590 is actuated so that movable element 594 is in contact with fixed contact 598, movable element 600 will be in contact with fixed contact 606. Current thus flows through conductor 608 to crank engine 240*b*, and through terminal member 612 and conductor 614 to apply voltage to junction 180*b*. Current then flows through relay coil 106*b* to ground 163*b*, causing movable contact member 130 to bridge stud portion 70 and 72 and energize glow plugs 238*b*.

Figure 17:
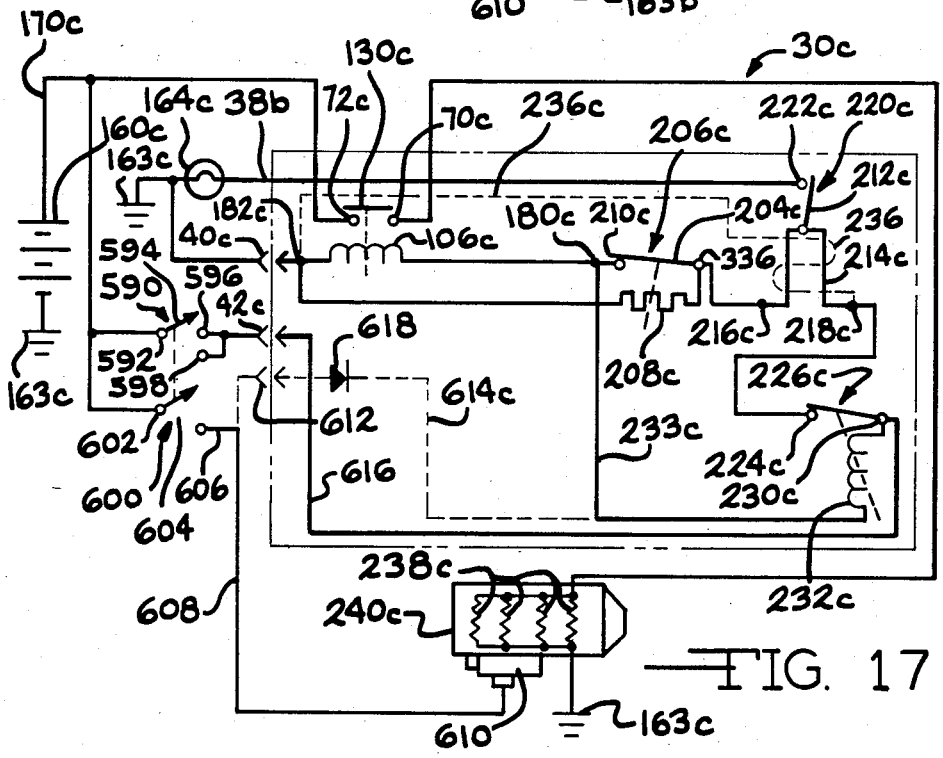
FIG. 17 is a second alternate circuit diagram for a control circuit according to the invention.

Turning now to FIG. 17, an embodiment of the invention is shown wherein switch means 184*b* is omitted, and switch means 206*b* is provided and retained. The embodiment of device 30*c* operates in much the same manner as the embodiment of FIG. 16. When switch means 590 is operated to place movable element 594 in contact with fixed contact 596, current flows through terminal member 42*b*, conductor 616, relay means 226*c*, continuous conductor 214*c*, switch means 206*c*, through relay coil 106*c* to ground 163*c*. Current will also flow through associated heater 208c connected between terminal 336c and junction 182c. At a first predetermined time, switch means 220c opens, extinguishing lamp 164c. At a second predetermined time, heat provided by associated heater 206c causes switch means 206c to open, deenergizing relay coil 106 and glow plugs 238c. At this time, relay means 226c opens, since the voltage appearing at junction 180c, connected to one end of coil means 232c, decreases from substantially the voltage of positive terminal 170c of battery 160c to a voltage substantially that of ground 163c. Relay means 226c remains energized, preventing further energization of glow plugs 238c if switch means 206c cools and recloses. However, if it is desired to energize glow plugs while cranking engine 240c, switch means 590 may be actuated to place movable element 594 in contact with fixed contact 598, thus placing movable element 604 of switch means 600 in contact with fixed contact 606. Current then flows through conductor 608 to cranking means 610 of engine 240c, and also to terminal member 612, through a diode 618, through conductor 614c to junction 180c, energizing relay coil 106c and glow plugs 238c. Diode 618 is provided so that voltage appearing at junction 180c will not energize cranking means 610 due to the voltage appearing at junction 180c when movable element 594 of switch 590 is in contact with fixed contact 596 or 598 and relay means 226c is de-energized and switch means 206c is closed.

Figure 18:
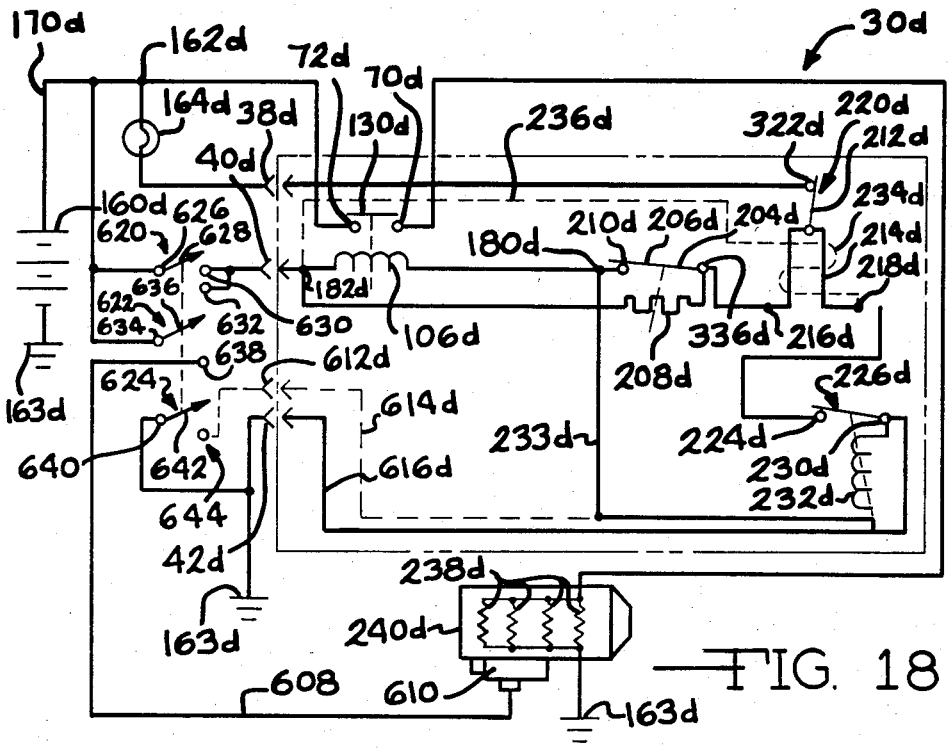
FIG. 18 is a third alternate circuit diagram for a control circuit according to the invention.

Referring now to FIG. 18, there is shown a control device 30d where switch means 184 has been omitted, and a ground is supplied to force energization of glow plugs 238d when an engine 240d is being cranked. A switch means 620 is shown as mechanically interlinked with a switch means 622 and a switch means 624. Switch means 620 includes a first terminal 626 connected to positive terminal 170d of batteries 160d, a movable element 628 and fixed contacts 630 and 632. Switch means 622 includes a first terminal 634 connected to positive terminal 170d, a movable element 636 and a fixed contact 638, connected to cranking means 610 by conductor 608. Switch means 624 includes a first terminal 640, a movable element 642 and a fixed contact 644 connected to terminal member 612d. When movable element 628 of switch means 620 is connected to fixed terminal 630, current flows through relay coil 106d, through temperature-actuated switch means 206d, continuous conductor 214d, relay means 226, to ground 163d through terminal 42d. At a first predetermined time, switch means 220 opens, extinguishing lamp means 164d. At a second predetermined time, current flowing through associated heater 206d causes switch means 206d to open, de-energizing relay coil 106d and glow plugs 238d, and causing relay means 226d to open, since coil means 232d is the remaining path to ground 163d for reduced current through relay coil 106d. This reduced current is insufficient to actuate relay coil 106d. When switch means 620 is actuated so that movable element 628 is in contact with fixed terminal 632, movable element 636 will be in contact with fixed terminal 638, supplying current to cranking means 610 of engine 240d, and movable element 642 will be in contact with terminal 644, connecting terminal 612d to ground 163d, allowing current flow through relay coil 106d, conductor 233d, and conductor 614d, to energize glow plugs 238d while engine 240d is being cranked.

Figure 19:
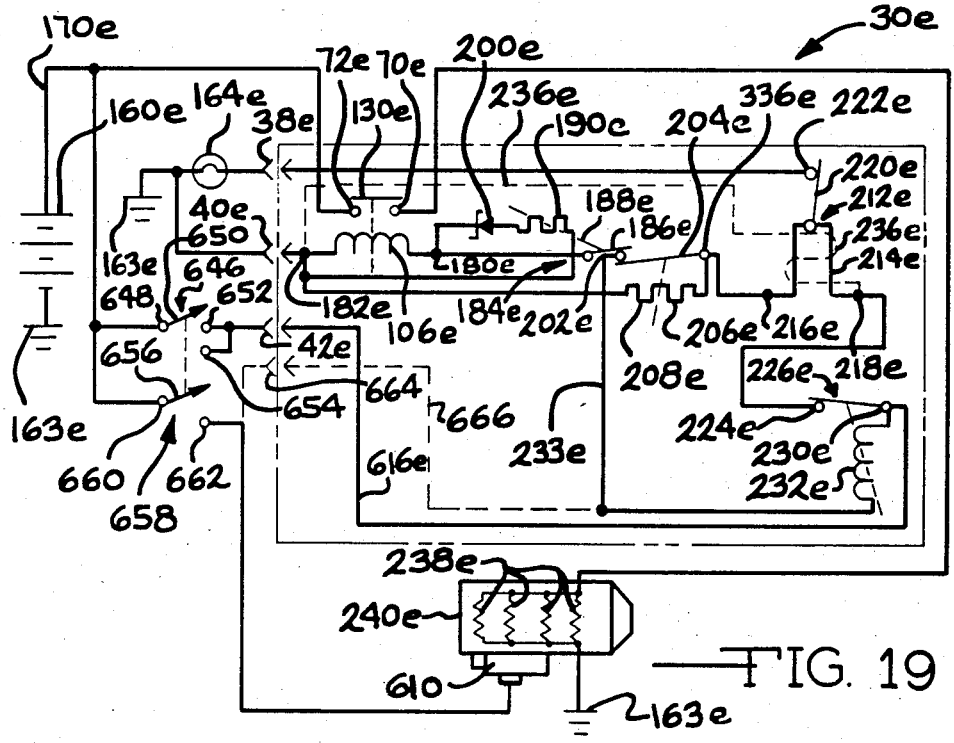
FIG. 19 is a fourth alternate circuit diagram for a control circuit according to the invention.

Referring now to FIG 19, a control device 30e according to the invention is shown, which is similar to that shown in FIG. 3, except for reversed polarity and the provision of means for forcing the energization of glow plugs 238e while engine 240e is being cranked. As can be seen, lamp means 164e has a first terminal connected to terminal member 38e and a second terminal connected to ground 163e. Terminal member 40e is also connected to ground 163e. Terminal member 42e is connected to positive terminal 170e of battery 160e through switch means 646, which has a first terminal 648 connected to positive terminal 170e, a movable element 650, and fixed contacts 652 and 654 connected to terminal member 42e. Movable element 650 is shown interlinked to movable element 656 of switch means 658, which includes a first terminal 660 connected to positive terminal 170e and a fixed contact 662 connected to cranking means 610 of engine 240e. Switch means 646 is actuated so that movable element 650 is in contact with terminal 652, current flows through switch means 646, into terminal member 42e, through conductor 616e, relay means 226e, continuous conductor 214e, switch means 206e, switch means 184e, relay coil 106e, to ground 163e through terminal member 40e. Current also flows through switch means 220 of continuous conductor 214e, to terminal 38e, illuminating lamp means 164e. Current will also flow through associated heater 236e of continuous conductor 214e, if provided, through conductor 236e connected to junction 182e and terminal member 42e. As with the embodiment of FIG. 3, current will also flow through associated heater 206e, and through associated heater 190e and zener diode 200e to junction 180e, if excessive voltage is applied to control device 30e. As before, diode 200e may be omitted, and heater means 190e constructed or adjusted so as not to provide sufficient heat to switch means 184e to cause its actuation when proper voltage is applied. After a first predetermined time, switch means 220e will open, extinguishing lamp 164e. After second predetermined time, associated heater 208e will cause switch means 206e to open, de-energizing glow plugs 238e, and allowing current to flow through relay coil means 232e to open relay means 226e. When movable element 650 is moved into contact with fixed contact 654, movable element 656 of switch means 658 will be in contact with fixed contact 662, supplying current to cranking means 610 of engine 240e. Also, current will also flow through a terminal member 664, a conductor 666 connected to terminal member 664 through a portion of conductor 233e to contact 202e, through switch means 184e, which is presumably still closed, through relay coil 106e to ground 163e, energizing glow plugs 238e.

Figure 20:
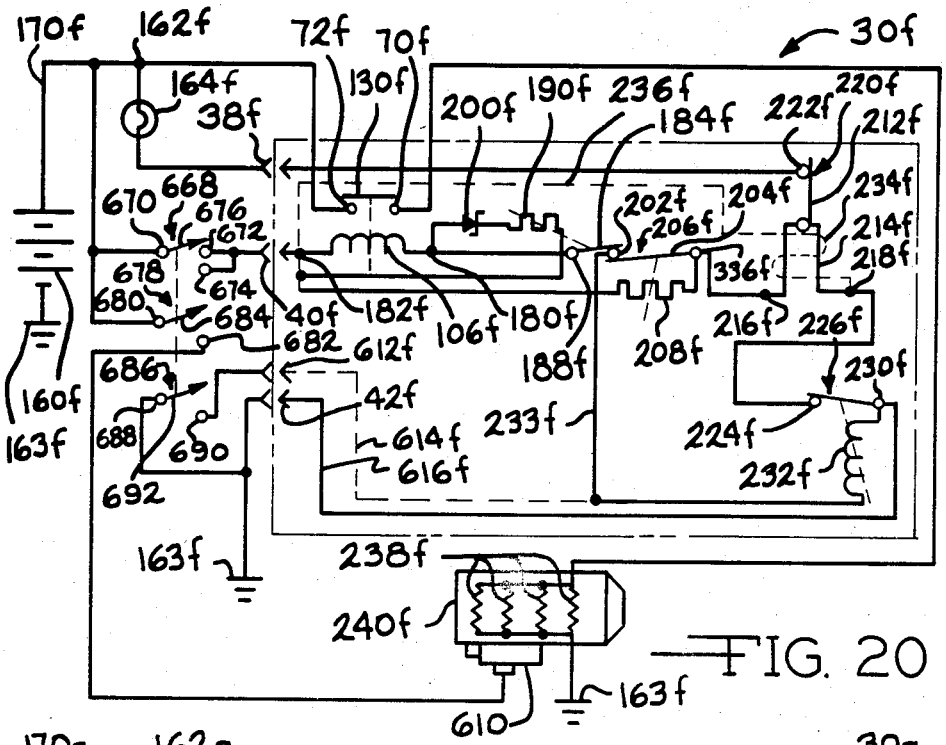
FIG. 20 is a fifth alternate circuit diagram for a control circuit according to the invention.

Turning now to FIG. 20, there is shown a control device 30f according to the invention, having the same polarity applied as the embodiment shown in FIG. 3, with the addition of means for forcing the energization of glow plugs 238f while engine 240f is being cranked. As shown, switch means 668 has a first terminal 670 connected to positive terminal 170f of battery 160f, and fixed contact 672 and 674, and a movable element 676. Switch means 678, mechanically interlinked to switch means 668, includes a first terminal 680 connected to positive terminal 170f of battery 160f, and a fixed contact 682 connected to cranking means 610 of engine 240f, and a movable element 684. A switch means 686, shown as mechanically interlinked to switch means 668 and 678, includes a first terminal 688, and a fixed contact 690 connected to terminal member 612d. First terminal 688 is connected to ground 163f, as is terminal member 42f. Switch 688 includes a movable element 692.

When switch means 668 is actuated to place movable element 676 in contact with fixed contact 672, current flows into terminal member 40*f*, through relay coil 106*f*, 184*f*, switch means 206*f*, continuous conductor 214, and relay means 226*f*, through conductor 616*f* to terminal member 42*f* and then to ground 163*f*. This energizes glow plugs 238*f*, and illuminates lamp means 164*f*. Current will also flow through associated heater 208*f*, connected between junction 182*f* and terminal 336*f*.

After a first predetermined time, switch means 220*f* will be actuated, extinguishing lamp means 164*f*. After a second predetermined time, switch means 206*f* will be opened, de-energizing glow plugs 238*f*, and energizing relay means 226*f*, since relay coil 232*f* is now the lowest impedance path for current from battery 160*f* to ground 163*f*.

If it is desired to crank engine 240*f* after switch means 206*f* has opened, and after relay means 226*f* has been energized, movable element 684 of switch means 678 is placed in contact with terminal 682, supplying current to cranking means 610 of engine 240*f* and movable element 692 is placed in contact with fixed terminal 690. Current then flows from contact 202*f*, through a portion of conductor 233*f*, through conductor 614*f*, to terminal member 612*f*. This allows current to flow through relay coil 106*f*, energizing glow plugs 238*f*.

Figure 21:
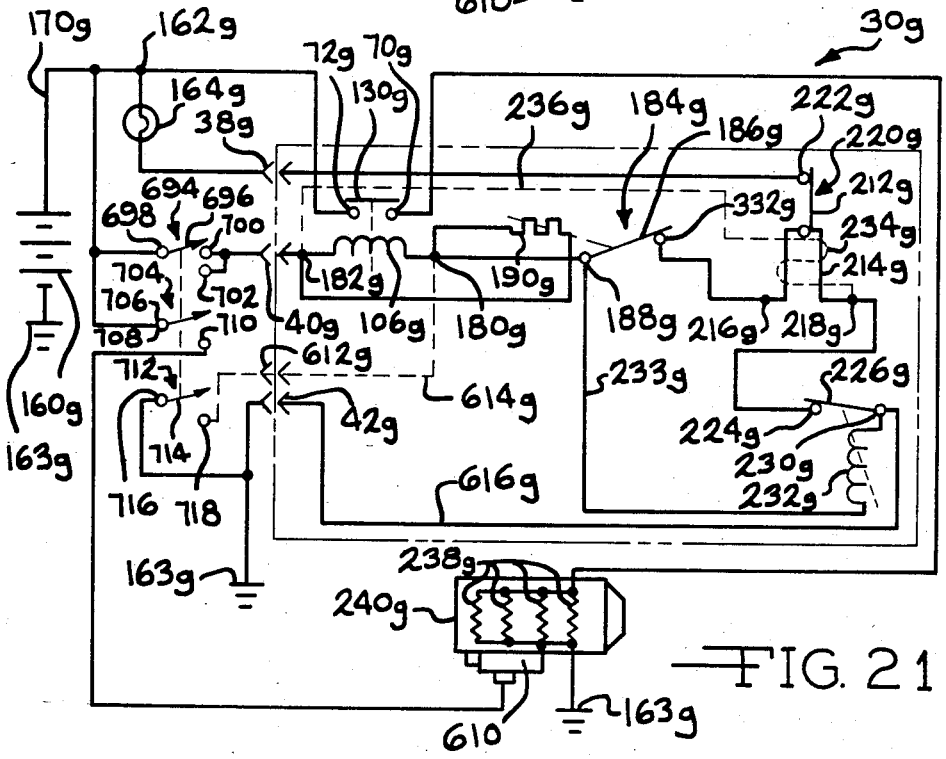
FIG. 21 is a sixth alternate circuit diagram for a control circuit according to the invention.

Turning now to FIG. 21, a control device 30*g* according to the invention is shown, being similar to FIG. 20, except that switch means 206*f* is omitted, and switch means 184*g* is used as a timing means. As shown, switch means 694 includes a first terminal 698 connected to positive terminal 170*g* of battery 160*g*, a movable element 696, and fixed contacts 700 and 702 connected to terminal member 40*g*. A switch means 704 includes a first terminal 708 connected to positive terminal 170*g* of battery 160*g*, a movable element 706, shown mechanically interlinked to movable element 696, and a fixed contact 710 connected to cranking means 610 of engine 240*g*. A switch means 712 includes a first terminal 714 connected to ground 163*g*, a movable element 714, shown as mechanically interlinked to movable element 706 and 696, and a fixed contact 718 connected to terminal member 612*g*. When switch means 694 is actuated so that movable element 696 is in contact with fixed contact 700, current flows into terminal member 40*g*, through relay coil 106*g*, switch means 184*g*, continuous conductor 214*g*, relay means 226*g*, conductor 616*g* to terminal member 42*g* and ground 163*g*. Current will also flow through associated heater 190*g*, connected between junction 180*g* and junction 182*g*. Current will also flow from positive terminal 170*g* of battery 160*g* through lamp 164*g*, conductor 236*g*, and switch means 220*g* of continuous conductor 214*g*, illuminating lamp 164*g*. After a first predetermined time, switch means 220*g* will open, de-energizing lamp means 164*g*. After a second predetermined period of time, associated heater 190*g* will cause switch means 184*g* to open, breaking the current path through relay coil 106*g*, and de-energizing glow plugs 238*d*. At this time, relay means 226*g* will be energized, opening relay means 226*g*, since terminal 188*g*, formerly at substantially the potential of ground 163*g*, will now become a potential of positive terminal 170*g* of battery 160*g*.

If it is desired to crank engine 240*g* following this second predetermined time, or at any other time when switch means 220*g* indicates, through lamp means 164*g*, that the engine 240*g* is not ready to be cranked, switch means 704 and 712 are actuated to place respective movable elements 706 and 714 in contact with fixed contact 710 and 718. Current will then flow through switch means 704 to cranking means 610, and current will flow from junction 180*g*, through conductor 614*g* to terminal member 612*g*, and through movable element 714 to ground 163*g*, forcing the energization of glow plugs 238*g*.

Turning again to FIGS. 10, 11, 12, 13, 14 and 15, in particular, the preferred method of fabricating the illustrated embodiment of the invention will become apparent. As will be obvious, conductor assembly 350 is a stamping, from a conductive material, with apertures 378, 392, 382, 398 and 408 formed by the stamping die, and tabs 420, 356, 354, 388 and 416 are bent at right angles to the plane of the remainder of conductor assembly 350 either by the stamping die, or by sequential use of stamping and bending dies. The design of such a die or dies is believed to be well within the skill of one knowledgeable in the art, and is believed to require no further explanation as to the structure of the dies involved.

Conductor assembly 350 is then insert molded into mounting block 352, in conventonal fashion. It should be noted that insert molding is a well-known phase of the molding art, involving putting the item to be insert molded into the molding die, the molding die being provided with appropriate pins or protrusions to hold the item in place while a plastic material is injected around it.

The design of such a die will be apparent from FIGS. 11–15. As can be seen, surface 454 is substantially flat, with various apertures allowing access to areas of conductor assembly 350 for severing severance areas and for installing mounting rivets, welding contacts and fixed ends of movable elements in place. The positioning and function of various apertures, including apertures 422 through 442 for severing severance areas 360 through 374, welding apertures such as apertures 452, 550, 552 and the like. As can also be seen, apertures 422 through 442 are substantially larger than severance areas 358 through 374, to allow placing a back-up die portion against the appropriate portion of conductor assembly 350 adjacent a severance area while punching out the severance areas. The fabrication of a die assembly for performing this task is believed to be a relatively simple assembly, and well within the skill of anyone familiar with the die making art, and thus requiring no further explanation.

As can also be seen from FIGS. 11–15, the top surface of mounting block 352 is also substantially flat, with various raised areas for mechanical spacings, apertures for providing access to conductor assembly 350, portions of apertures 422–442 for obtaining access to severance areas 358 through 374, and posts 510, 512 for supporting relay means 226*a*. Also, as can be seen best in FIG. 11, mounting block 352 is provided with reinforcing portions 740 surrounding a base portion of terminal member 38*a*, reinforcing portion 742 surrounding a base portion of terminal member 40*a*, reinforcing portion 744 surrounding a base portion of terminal member 42*a*, reinforcing portion 746 surrounding a base portion of terminal member 44*a*, and reinforcing portion 748 surrounding a base portion of terminal member 46*a*. After assembly, these reinforcing portions appear as tower portions 50–58 in FIG. 1.

As can best be seen in FIG. 12, surface 750 is substantially flat and defines an aperture 752 for access to portion 402 of conductor assembly 350 for fastening second end 558 of element 228*a* thereto, and an aperture 754 for providing access to portion 384 of conductor assembly 350 for attaching contact 224*a* thereto, and for providing clearance around first end 556 to allow contact 554 to engage contact 224*a*, as well as a raised portion 756, for supporting first and second terminals 216*a* and 218*a* of U-shaped continuous conductor 214*a* in the desired relationship with set screw 470, which defines fixed contact 222.

As can be seen in FIG. 13, surface 750 also includes a raised portion 758 for supporting fixed end 468 of switch means 206*a*, and barrier portions 760, for preventing end 468 from pivoting about rivet 462 when set screw 464 is rotated to adjust the contact pressure between contacts 450 and 456. An aperture 762 is provided with surface 750 for access for fastening contact 450 to portion 394 of conductor assembly 350, and for providing clearance for tip portion 306*a* of switch means 206*a*.

In FIG. 14, an aperture 764 in surface 750 is provided around set screw 470, in alignment with aperture 472, and an aperture 766 is provided for access to sixth area 410 for fastening contact 332 in place. A depression or aperture 768 is provided to provide clearance to allow for bowing of element 186*a* when set screw 500 is rotated to bear against stiffener 770, contact carrier portion 488 and element 490, to adjust the contact pressure between contacts 496 and 332.

As will be apparent, numerous modifications in the order of the series-connected elements described, and in their mechanical positioning and support, may be made without departing from the spirit and scope of the invention.

We claim:

1. A method of making a control device for diesel engines for energizing at least one glow plug when the engine is being started, comprising the steps of:

providing a conductor assembly;

embedding said conductor assembly in a mounting block of an insulating material, said mounting block defining a plurality of first apertures and a plurality of second apertures therein;

severing predetermined portions of said conductor assembly aligned with each said first aperture to define a plurality of circuit elements;

mounting at least a first temperature-actuated switch means and a second temperature-actuated switch means to predetermined ones of said circuit elements aligned with said second apertures; and then providing a power relay means adapted to be connected to said conductor assembly and to said glow plug for energizing said glow plug.

2. A method of making a control device according to claim 1, including the further steps of:

providing a housing opened at one end and having a plurality of terminals extending from said housing, said housing including means for defining a first chamber and a second chamber therein;

mounting said conductor assembly in said first chamber and electrically connecting other predetermined ones of said circuit elements on said conductor assembly to predetermined ones of said terminals;

mounting said power relay means in said second chamber and electrically connecting said power relay means to other predetermined ones of said terminals for connecting to said glow plug;

electrically connecting said power relay means and said conductor assembly; and then enclosing said open end of said housing forming a unitary structure.

3. A method of making a control device for diesel engines for energizing at least one glow plug when the engine is being started, comprising the steps of;

providing a control circuit assembly;

providing a power relay means adapted to be connected to said control circuit assembly and to said glow plug for energizing said glow plug;

providing a housing means open at one end for gaining access to a first independent chamber having a plurality of terminals extending from said housing and a second independent chamber having at least two terminals extending from said housing adapted to be connected to said glow plug;

placing said control circuit assembly in said first chamber and electrically connecting said control circuit assembly to said terminals;

placing said power relay means in said second chamber and in operative relationship to said at least two terminals;

connecting said control circuit assembly and said power relay means and then enclosing said open end of said housing forming a unitary structure having independent chambers for said control circuit assembly and said power relay means.

4. A control device for diesel engines for energizing at least one glow plug when the engine is being started, comprising:

a control circuit assembly;

a power relay means operably connected to said control circuit assembly;

a housing means open at one end and having a first chamber, said control circuit assembly being disposed in said first chamber, and having a second chamber, said power relay means being disposed in said second chamber and electrically connected to said control circuit assembly in said first chamber; and a cover plate including sealing means, said cover plate removably fastened to said open end of said housing means forming a unitary structure.

5. A control device according to claim 4, wherein:

said second chamber is a cylindrical chamber defining apertures in an end wall thereof for receiving terminal studs of said power relay means therethrough for connection to said glow plug.

6. A control device according to claim 5, wherein:

said first chamber is a rectangular chamber provided with apertures in an end wall thereof for receiving terminal members of said control circuit assembly therethrough.

* * * * *